United States Patent [19]

Ichimura et al.

[11] 4,331,371

[45] May 25, 1982

[54] ELECTRICAL CONNECTOR

[75] Inventors: Yoshiaki Ichimura, Akishima; Yusaku Inoue, Hino, both of Japan

[73] Assignee: Japan Aviation Electronics Industry, Ltd., Tokyo, Japan

[21] Appl. No.: 125,521

[22] Filed: Feb. 28, 1980

[30] Foreign Application Priority Data

Mar. 9, 1979 [JP] Japan ..... 54-28020
Mar. 9, 1979 [JP] Japan ..... 54-28021
Mar. 13, 1979 [JP] Japan ..... 54-28916

[51] Int. Cl.[3] ..... H01R 13/62
[52] U.S. Cl. ..... 339/74 R
[58] Field of Search ..... 339/74 R, 75 R, 75 M

[56] References Cited

U.S. PATENT DOCUMENTS 3,763,459 10/1973 Millis ..... 339/75 M
4,245,877 1/1981 Auriana ..... 339/74 R

FOREIGN PATENT DOCUMENTS 702778 2/1941 Fed. Rep. of Germany ... 339/75 M
940332 10/1963 United Kingdom ..... 339/75 M
961713 6/1964 United Kingdom ..... 339/75 R

*Primary Examiner*—Joseph H. McGlynn
*Attorney, Agent, or Firm*—Hammond & Littell, Weissenberger and Muserlian

[57] ABSTRACT

A zero insertion force type connector for connecting pins of an integrated circuit package, which comprised a housing having a plurality of recesses separated from each other by a partition, electrical contact terminals being mounted in the housing through an opening in the slider which is mounted in the recess. The contact terminal comprises a web, blade and terminal portion. The web is formed to provide a resilient body and the blade is provided with an opening which has an enlarged portion and a narrow slot. The web portion is driven by the slider to align the enlarged portion of the opening in the blade with the pin to be connected and when the web portion is returned to its original position, the pin is grasped in the slot and brought into contact with the contact terminal.

8 Claims, 14 Drawing Figures

FIG. 1
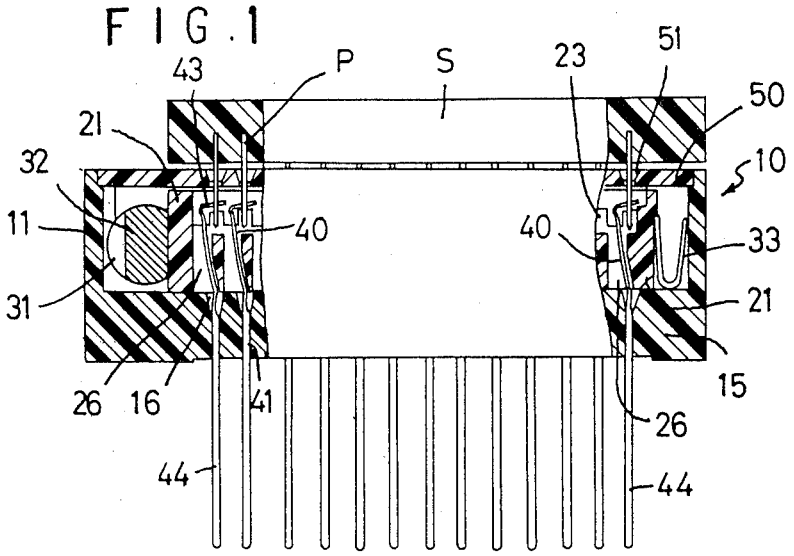
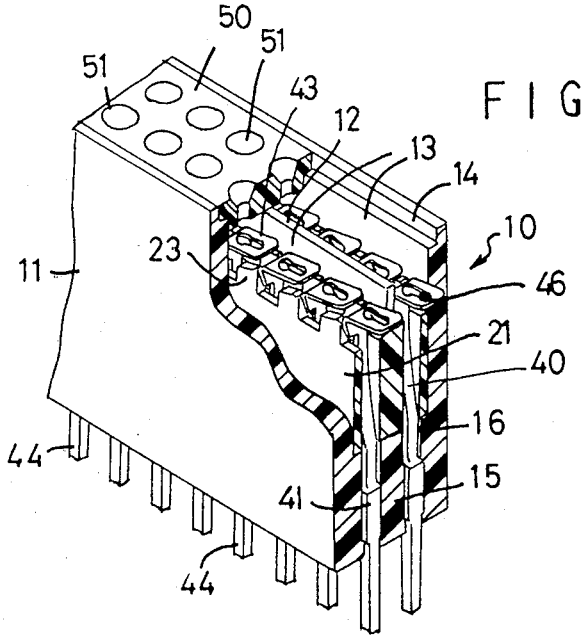
FIG. 2

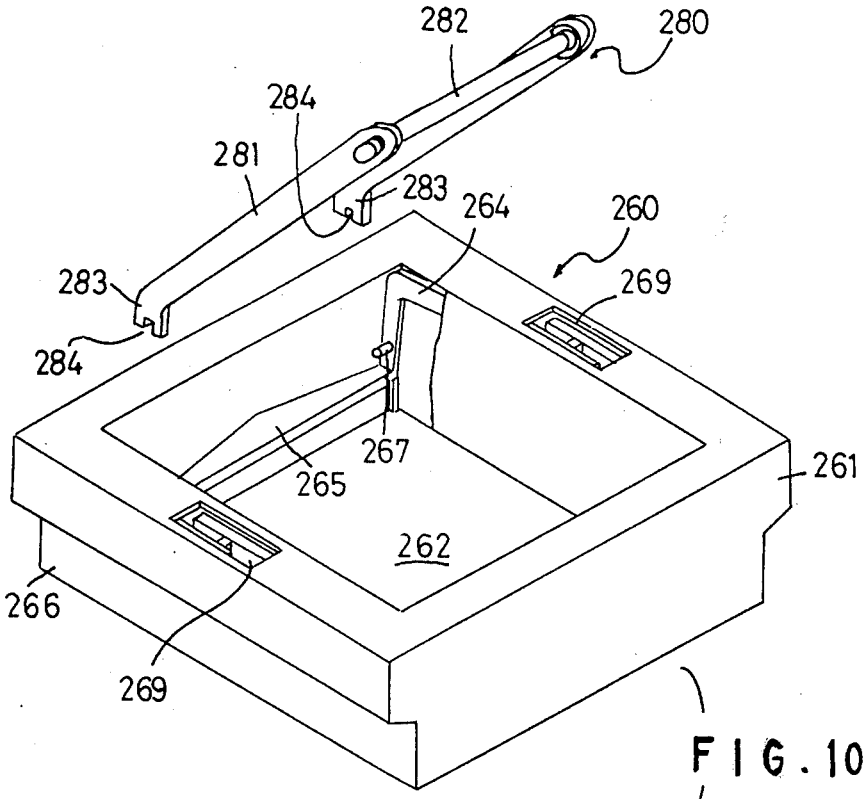
FIG. 10
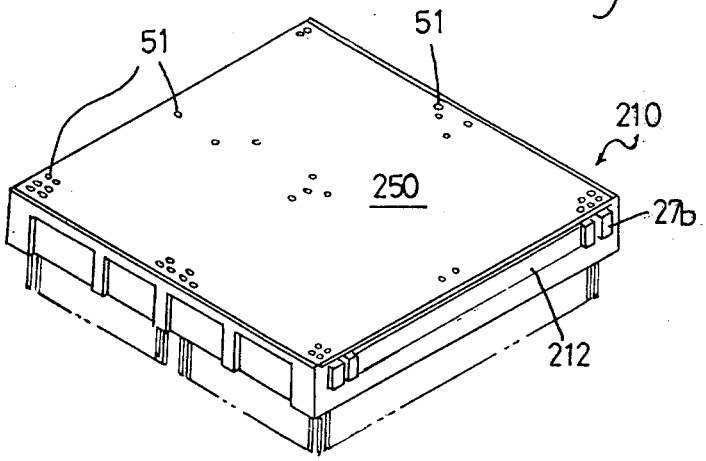

ELECTRICAL CONNECTOR

BACKGROUND OF THE INVENTION

This invention relates to an electrical connector eminently suited for establishing circuits in conjunction with printed circuit boards. More particularly the invention relates to an electrical connector in which the insertion force required to insert pin conductors of a printed circuit board or an integrated circuit package into the connector is substantially zero.

It is generally known to use electrical connectors of zero insertion force type for connecting the pin conductors of integrated circuit packages with the contact terminals in a connector or socket.

In "zero insertion force type" connector of the prior art, the pin conductor is inserted into a hole in the conductor without applying any force, and connection between the pin conductor and the contact terminal has been accomplished by urging the contact terminal by driving means so as to bring it into contact with the pin conductor inserted. In the case where a large number of contact terminals are arranged in the connector, a great force is required to drive the contact terminals.

In such a case, the strength of the connector and the parts thereof must be considered carefully and the connector is substantially complicated in construction.

Further, there is a disadvantage that if the driving means or mechanisms are contained in the connector, the connector is increased in its dimensions.

OBJECTS OF THE INVENTION

It is accordingly the objects of the present invention to provide an electric connector of the zero insertion force type having a large number of contact terminals which may be biased to the pin conductors with the exertion of the minimum force.

It is another object of the present invention to provide a zero insertion force type connector which is simple in construction and reliable in operation.

It is a further object of the present invention to provide a novel zero insertion force type connector which is small in size.

Another important object of the present invention is to provide a novel zero insertion force type connector in which the contact terminals are driven by a separate device.

These and other objects and advantages of the present invention will become more apparent in the following description and accompanying drawings in which like numerals refer to like parts.

BRIEF DESCRIPTION OF THE DRAWINGS

FIG. 1 is a partially cross-sectional view of one embodiment of the connector according to the invention, and in which pin conductors of an integrated circuit package are inserted into the connector;

FIG. 2 is an enlarged fragmentary perspective view of the housing of the connector;

FIG. 10 is a perspective view of the third embodiment of the connector according to the present invention;

DETAILED DESCRIPTION OF PREFERRED EMBODIMENT

Figure 3:
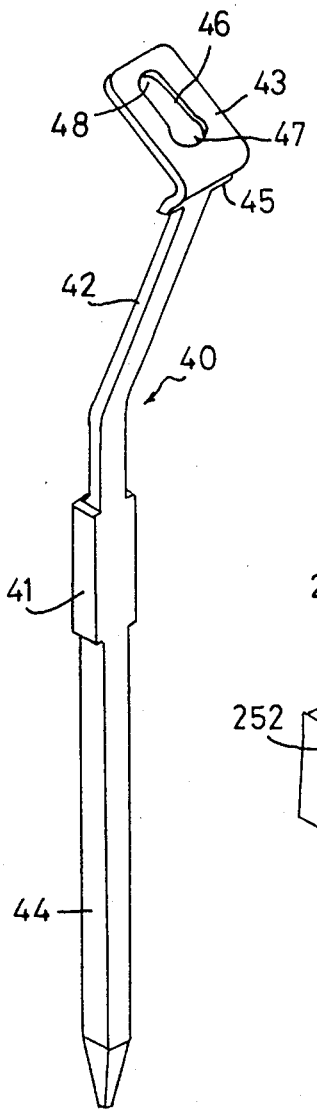
FIG. 3 is an enlarged perspective view of a contact terminal to be supported on the connector of the present invention.

Now the first embodiment of the present invention will be described in detail with reference to the drawings. In FIGS. 1 and 2, numeral 10 generally designates a connector. The connector 10 is formed of a plastic or other dielectric material so as to provide an elongated integral socket or housing 11. The housing 11 is provided with two parallel openings or recesses 13 which are separated from each other by means of a longitudinal partition 12. The recesses 13 are opened in the upper surface 14 of the housing 11 and are provided with a series of openings 16 in a bottom wall 15 of the recess at regular intervals.

To each recess 13 in the housing 11, a slider 21 of an electrically non-conductive material is mounted so that it is slightly slidable longitudinally along the recess 13. The slider 21 is provided with a series of openings 26 and a pair of shoulder portions 23 so as to protrude from the upper side walls of each opening 26.

A shaft 31 is suitably journaled at one end of the socket or housing 11 and carries an elongated cam member 32. The slider 21 is resiliently urged towards the cam member 32 by means of a leaf spring element 33 suitably supported between one end of the slider and the other end of the housing. When the cam member 32 is rotated by means of the shaft 31, the slider 21 moves against the force of the leaf spring element 33.

A series of electric terminals or contacts 40 are respectively received in the opening 22 in the slider 21 and protruded outwardly from the housing 11 passing through the opening 16 in the bottom 15 of the housing.

The details of one of preferred embodiments of the contacts 40 are best shown in FIG. 3, from which it will be apparent that each of the individual contacts 40 consists of a single integral stamping of relatively thin sheet metal. The contact 40 is preferably formed to include a mounting shank portion 41 in the form of a four sided shape and provided with a longitudinally extending web portion 42, a blade portion 43 and a terminal portion 44.

The mounting shank portion 41 of the contact 40 is fixedly received in the opening 16 in the bottom wall 15 of the housing 11. The web portion 42 of the contact 40 is spring tempered to provide a resilient body and formed at a slight angle of inclination with respect to the longitudinal axis of the mounting shank portion 41.

The blade portion 43 of the contact 40 is shaped as shown in FIG. 3 and formed at a right angle with respect to the longitudinal axis of the web 42. The inclined web portion 43 includes shoulders 45 at its junction portion. The shoulders 45 of the web may be contacted with the shoulders 23 of the slider 21 respectively. As seen, the inclined blade portion 43 of the contact 40 is provided with a keyhole or wedge shaped aperture 46 which includes an enlarged portion 47 and a longitudinally extending narrow slot 48. The enlarged portion 47 of the keyhole aperture 46 is sized to be somewhat larger than the diameter of a pin P to be inserted thereinto.

A cover plate 50 is mounted on the upper surface 14 of the housing 11 of the connector so as to cover the recesses 13. The cover plate 50 is provided with a plurality of guide openings 51 to insert pins P of an integrated circuit package S, for example.

From the foregoing it will be evident that when the shaft 31 is turned for 90° from the position shown in FIG. 1, the slider 21 moves against the force of the leaf spring 33, and the shoulder 23 of the slider 21 drives the shoulder 45 of the contact 40 so that the web portion 42 of the contact 40 is resiliently forced to align with the enlarged portion 47 of the aperture 46 with the opening 51 in the cover plate 50. Thus the pin P may be inserted through the guide opening 51 into the enlarged portion 47 of the keyhole aperture 46 in the blade portion 43.

Then, the cam 32 is turned to the original position shown in FIG. 1, the slider 21 is moved by means of the leaf spring element 33, the web portion of the contact 40 is restored to the original state by its resiliency, and the pin P is received and grasped firmly in the narrow slot portion 48 of the aperture 46 in the blade portion 43 so that the good connection between the contact 40 and the pin P may be achieved.

Figure 6:
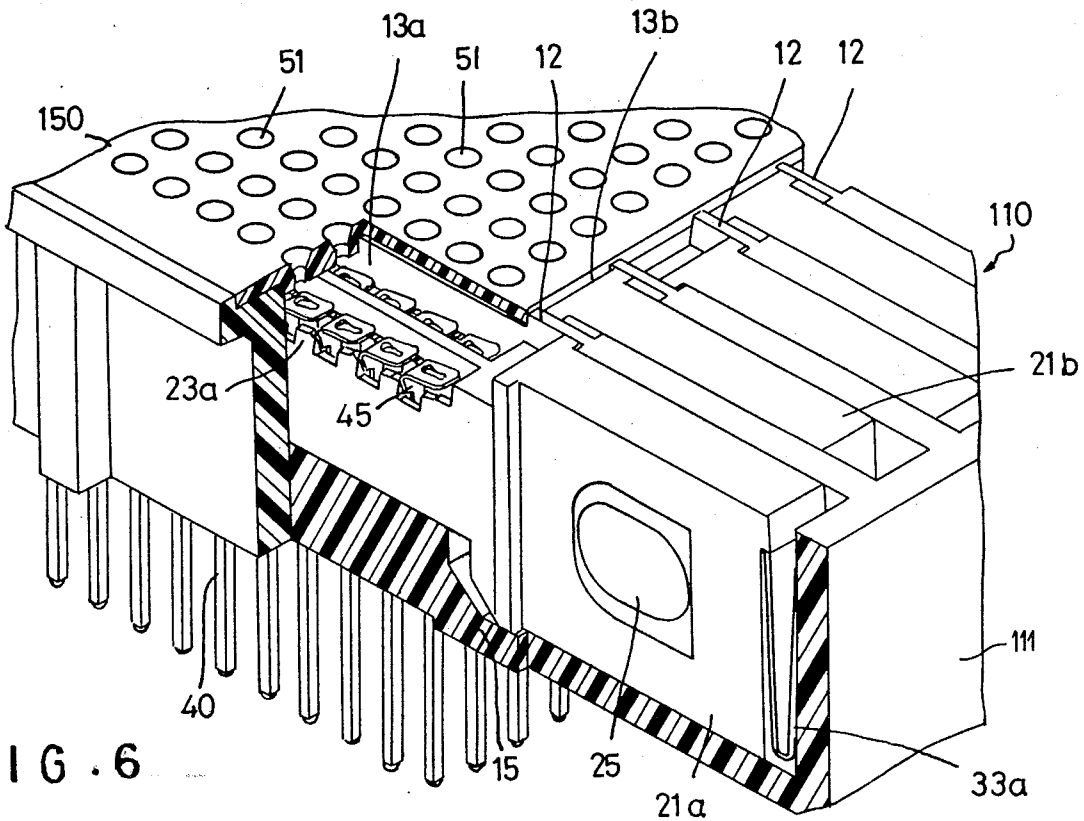
FIG. 6 is an enlarged broken perspective view of the second embodiment shown in FIG. 4.
Figure 7:
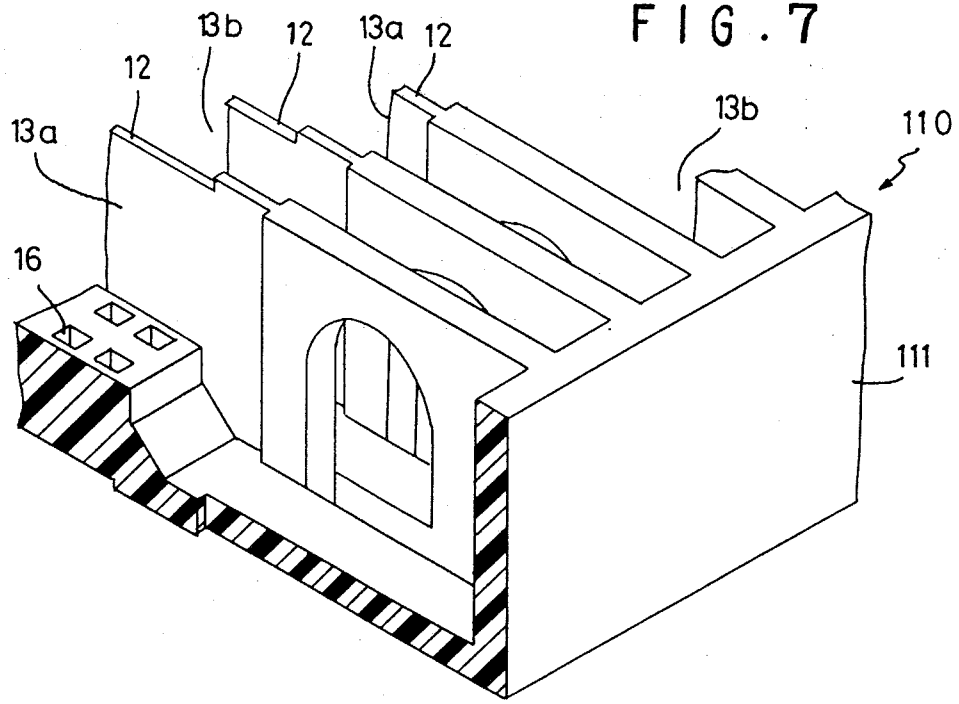
FIG. 7 is a perspective view illustrating a portion of the housing shown in FIG. 4.

Referring now to FIGS. 4 to 9 which illustrate the second embodiment of the connector of the present invention, the connector 110 is used for mounting an integrated circuit package of square or rectangular configuration having a plurality of pins P on one surface of a planner substrate S. As shown in FIGS. 6 and 7, a housing 111 of the connector 110 is provided with a plurality of grooves or recesses 13*a* or 13*b* which are separated from each other by means of a partition 12.

To each recess 13*a* or 13*b* in the housing 111, a slider 21*a* or 21*b* of an electrically non-conductive material is mounted so that it is slightly slidable longitudinally along the recess 13*a* or 13*b*. Although the sliders 21*a* and 21*b* are similer in form, the face of each of the shoulder portions 23*a* of the slider 21*a* is opposed to the face of the shoulder portion 23*b* of the slider 21*b*.

Figure 4:
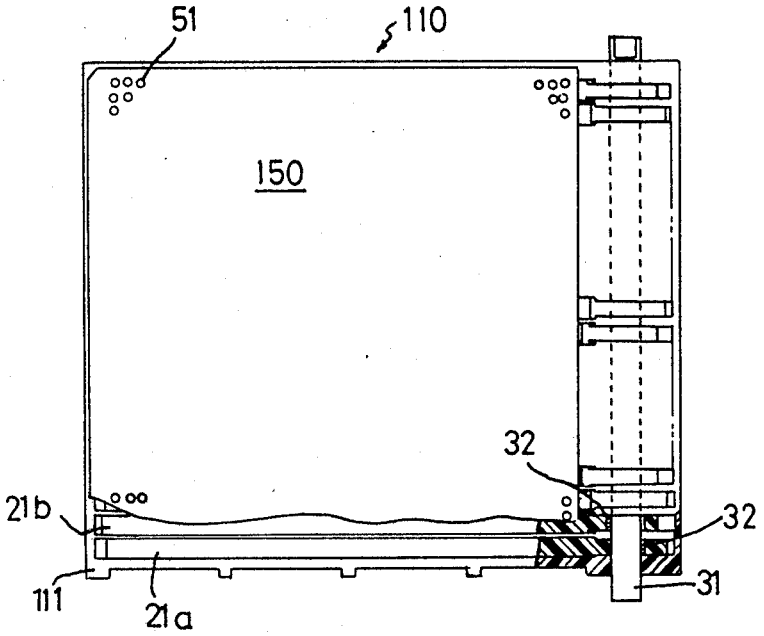
FIG. 4 is a partially broken plane view of the second embodiment of the invention.
Figure 5:
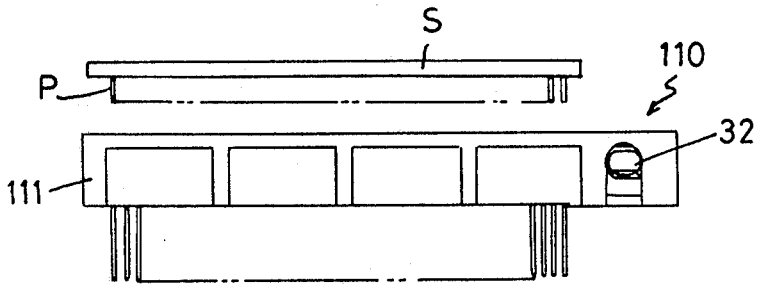
FIG. 5 is a schematic side elevation of the connector of FIG. 4.

As shown in FIG. 4 a shaft 31 is suitably journaled at one end of the housing 111 and carries a plurality of elliptic cam members 32 each of which is arranged in the position corresponding to the row of the recess 13*a* or 13*b*. The slider 21*a* or 21*b* is provided with an opening 25 for receiving the cam member 32 therein. A leaf spring member 33*a* is arranged in the recess 13*a* between the end of the slider 21*a* near the opening 25 and the end wall of the housing 111, and a further leaf spring member 33*b* is arranged in the recess 13*b* between the end of the slider far from the opening 25 and the end wall of the housing so that the sliders 21*a* and 21*b* may be cooperated with the respective cam member 32. When the cam members 32 are rotated by means of the shaft 31, the sliders 21*a* and 21*b* move against the force of the leaf springs 33*a* and 33*b* in opposite direction each other.

A series of electric terminals or contacts are respectively received in the opening in the slider 21*a* or 21*b* and protruded outwardly from the housing 111 passing through the opening 16 in the bottom 15 of the housing. The face of the shoulder 45 of the contact member 40 arranged in each of the sliders 21*a* and 21*b* is opposed to each other and the shoulder 45 of the blade 43 may contact with the shoulders 23*a* and 23*b* in each of the sliders 21*a* and 21*b*.

A cover plate 150 is mounted on the upper surface of the housing 111 to cover the recesses therein. The cover plate 150 is provided with a plurality of guide openings 51 to insert pins P of an integrated circuit package, for example.

Figure 8:
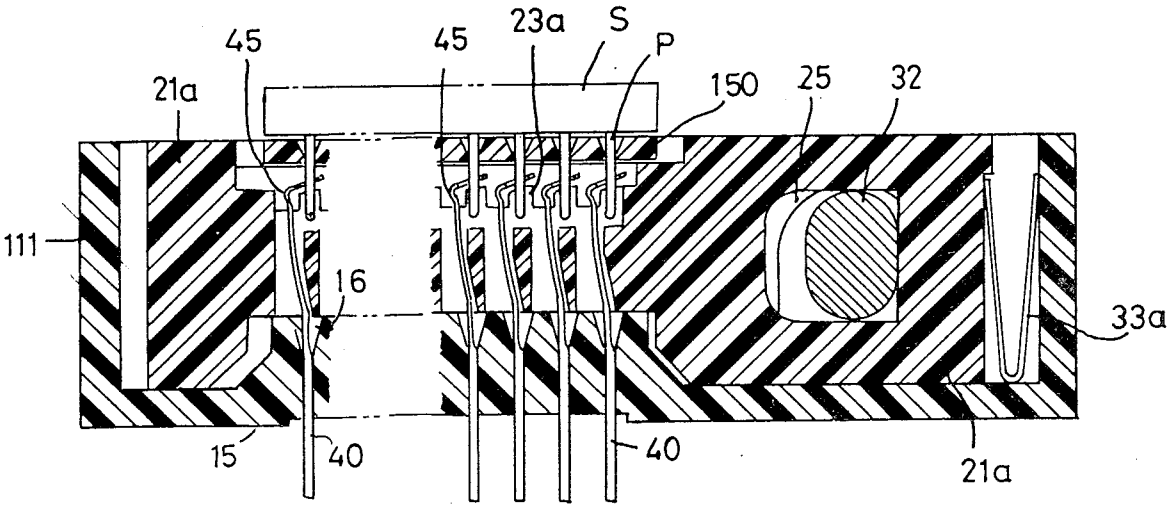
FIGS. 8 and 9 are respectively a sectional view of a slider to be assembled in the connector of the second embodiment shown in FIG. 4.
Figure 9:
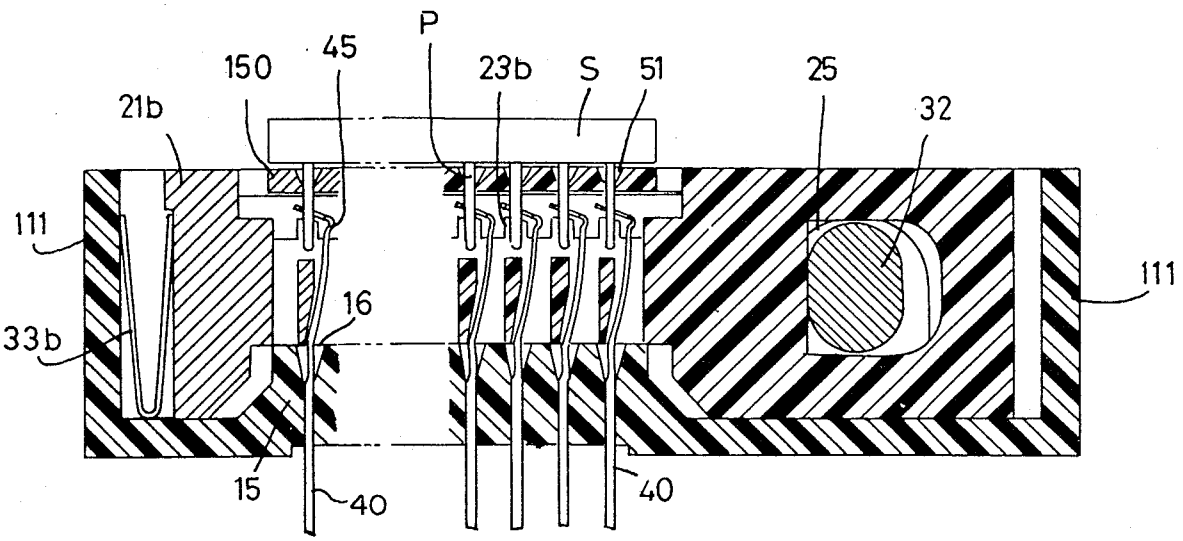

From the foregoing it will be apparent that when the cam 32 is turned for 90° from the position shown in FIGS. 8 and 9, the sliders 21*a* and 21*b* are moved by means of the force of the leaf springs 33*a* and 33*b* respectively, the shoulder portion 23*a* or 23*b* of the slider 21*a* or 21*b* drives the shoulder 45 of each of the contact elements 40, and the shoulder 23*a* or 23*b* of the slider 21*a* or 21*b* drives the shoulder 45 of the contact element 40 so that the web portion 42 of the contact 40 is resiliently forced to align with the enlarged portion 47 of the opening 46 in the blade portion 43. Thus, when the substrate S of the integrated circuit package is mounted on the connector housing 111, each of the pins P of the substrate S may be received in the respective enlarged opening 47 in the blade 43 of the contact 40 under zero insertion force.

Then, the cam 32 is returned to the original position shown in FIGS. 8 and 9, the sliders 21*a* and 21*b* are respectively moved by the leaf springs 33, and each of the pins P inserted in the enlarged portion 47 of the aperture 46 in the blade portion 43 of the contact 40 may be received and grasped firmly in the narrow slit portion 48 of the aperture 46.

In the second embodiment of the present invention, forces applied to the cam shaft 31 at equal distances are the same in strong and opposed to each other in sense so that the forces applied to the shaft 31 are balanced.

Referring now to FIGS. 10 to 13, wherein the third embodiment of the connector according to the present invention is shown. This connector 210 is suitable to mount an integrated circuit package having a plurality of pins P which are distributed over a square or rectangular substrate S in horizontal rows and vertical columns.

The housing or frame 211 of the connector 210 is provided with a plurality of grooves or recesses 13 which are parallel to and separated from each other by means of a partition as mentioned above.

To each recess 13 in the housing 211, a pair of sliders 121*a* and 121*b* of an electrically non-conductive material are mounted so that they are slightly slidable longitudinally along the recess 13. Although the sliders 121*a* and 121*b* are similar as the slider 21 of the first embodiment in form, the face of each of the shoulder portions 123*a* which are protruded upwardly from both sides of the slider 121*a* is opposed to the face of each of the shoulder portions 123*b* of the slider 121*b*.

A leaf spring member 33 is arranged between the sliders 121*a* and 121*b* in the middle of the recess 13 so that the sliders 121*a* and 121*b* are urged by the spring member 33 to separate one from the other.

At one end of each of the sliders 121*a* and 121*b*, a project portion 27*a* or 27*b* is formed. The housing 211 is provided with an elongated opening 212 at the both sides to protrude the project portion 27*a* or 27*b* of the slider 121*a* or 121*b* passing through the opening 212 outwardly from the housing 211.

Figure 14:
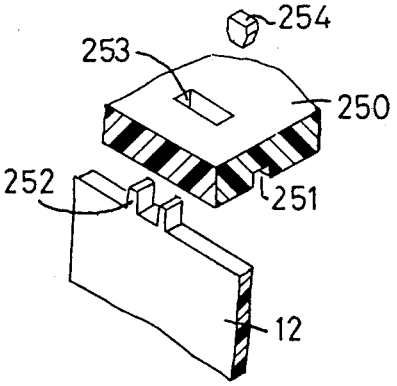
FIG. 13 is a partially sectional view showing sliders assembled in the connector of the third embodiment of the invention and FIG. 14 is a perspective view illustrating means for mounting a cover plate on the connector of the third embodiment of the present invention.

A cover plate 250 is mounted on the upper surface of the housing 211 to cover the recesses therein. The cover plate 250 is provided with a plurality of guide openings 51 to insert pins P of an integrated circuit package substrate S. The cover plate 250 is fixed to the housing 211 by suitable means. To this end, for example, as shown in FIG. 14, on the under side of the cover plate 250 a plurality of grooves 251 are formed to receive the upper side of each of the partition walls 12.

To position the cover plate 250 with respect to the housing 211, the partition wall 12 is provided with protrudes in U-configuration on the upper edge of the partition. On the other hand, the cover plate 250 is provided with openings 253 each of which receives a pair of protrudes 252. After the cover plate 250 has been mounted on the housing 211 and a pair of protrudes 252 are inserted into the corresponding opening 253, a wedge member 254 which is somewhat larger than the distance between the protrudes may be forced into between the protrudes 252 to fix the cover plate 250 on its position.

A specific driving device is used for inserting each of the pins P of the integrated circuit packages S into the enlarged portion 47 of the aperture 46 in the blade portion 43 of each of the contacts according to the third embodiment of the present invention and for grasping the pin P in the narrow portion 48 of the aperture 46.

The driving device is constructed to mount on the housing 211 and to press the end portions 27*a* and 27*b* which are respectively protruded outwardly from the side wall of the housing 211 through the respective elongated opening 212 therein against the force of the leaf spring 33 between the sliders 121*a* and 121*b* so that the enlarged portion 47 of the aperture 46 in the blade 43 of each contact element 40 is aligned with the opening 51 in the cover plate 250.

Figure 11:
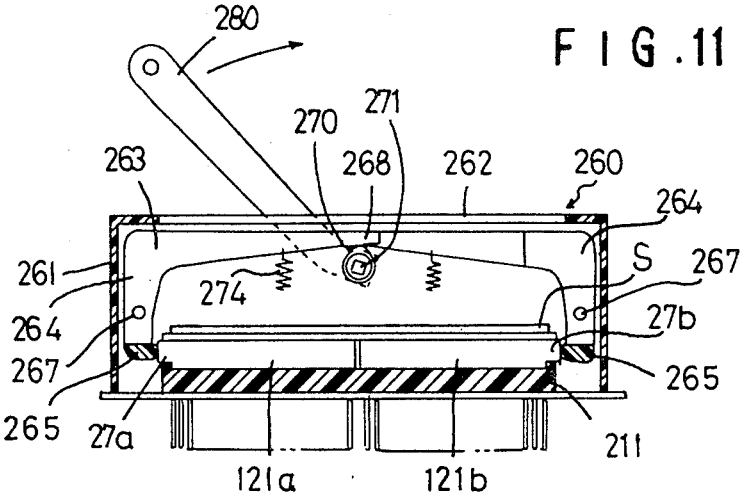
FIG. 11 is a sectional view of the connector explaining the third embodiment of the present invention.
Figure 12:
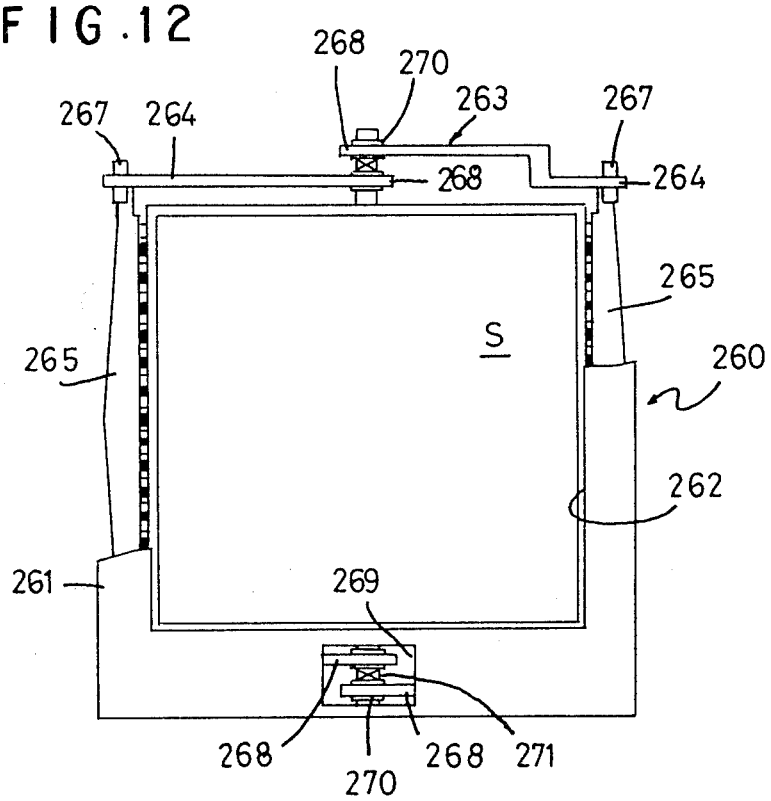
FIG. 12 is a partial cut away plane view illustrating a construction of the connector shown in FIG. 11.
Figure 13:
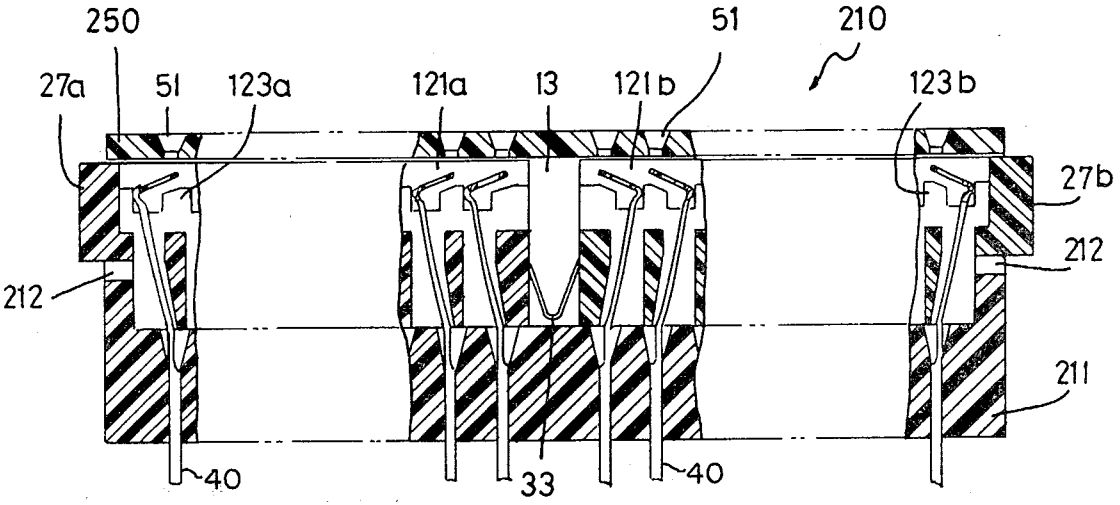

Referrring now to FIGS. 10, 11 and 12, there are shown a preferred embodiment of the driver 260 adapted to be used for the connector 210 of the third embodiment of the present invention. The driver 260 consists of a frame 261 which is adapted to mount on the connector housing 211. The driver frame 261 is provided with a square or rectangular opening 262 in the center of the frame so as to mount the integrated circuit package substrate S passing through the opening 262 on the connector housing 211. The frame 261 is provided with arm members 263 for pressing into the protruded ends 27*a* and 27*b* of the sliders 121*a* and 121*b* respectively. Each of the arm members 263 consists of a pair of levers 264 in L-configuration and a press member 265 which is extended between the ends of the levers 264. The lever is pivotally mounted to the side wall 266 of the frame by means of a pin member 267. The free end 268 of the lever 264 is contacted with the surface of an oval cam member 270 by means of a coil spring 274. The cam member 270 is mounted on a square shaft 271 which is supported by the frame 261 at the upper middle portion thereof.

The frame of the driver 260 is provided with openings 269 for accessing to each of the square shafts 271. The shaft 271 may be turned by means of a hand lever means 280 which consists of a pair of lever arms 281 and a bar 282 which is connected between the lever arms 281. The free end 283 of the arm lever means 280 is formed to insert into the opening 296 in the frame 261 and is provided with a notch 284 which is formed to receive the square shaft 271.

When the free ends 283 of the hand lever means 280 are respectively inserted into the openings 269 in the frame 261 and the hand lever means 280 is turned for about 90° to move the square shaft 271 which is received in the notch 284 in the free end 284 of the lever means 280, the free end 268 of the lever 264 mounted on a major arc surface of the elliptic cam 270 is rotated about the pin 267, and then the sliders 121*a* and 121*b* are respectively moved against the leaf spring 267 so that the blade portion 43 of each of the contacts 40 is the connector is driven by the shoulder of the slider.

Accordingly, the enlarged portion 47 of the opening in the blade of the contact 40 is aligned with the guide opening 51 in the cover plate 250 so that each of the pins P of the integrated circuit package S is inserted into the enlarged portion 47 of the opening in the blade of the contact 40 without requiring any insertion force. In this instance, when the lever means 280 is turned to return the oval cam 270 to its original position, forces which are applied to the sliders 121*a* and 121*b* are removed, and the sliders 121*a* and 121*b* are respectively returned to its original position by means of the leaf spring 33. Thus, the pin P which is inserted into the enlarged portion 47 of the opening in the blade of the contact 40 is grasped in the narrow slot portion 48 of the opening in the blade of the contact.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector comprising a housing formed as a single piece of dielectric material having a plurality of recesses separated from each other by a partition, a slider in each of said recesses, a plurality of electrical contact terminals arranged in said slider, driving means for moving said sliders along said recesses, and a cover plate having a plurality of openings for guiding pins to be connected, each said electrical terminal consisting of a single member formed to include a mounting shank portion, a resilient web portion and a blade portion, said web portion being formed at a slight angle of inclination with respect to said shank portion, said blade portion being provided with an aperture including an enlarged portion and a narrow slot, each said slider having a plurality of protruding shoulders, and said inclined web portion of said terminals being driven by said shoulders of the slider whereby said enlarged portion of the aperture is aligned with said opening in said cover plate.

2. An electrical connector claimed in claim 1, in which said driving means is a leaf spring and a cam member which are mounted in said housing.

3. An electrical connector comprising a housing formed as a single piece of dielectric material having a plurality of recesses separated from each other by a partition, a slider in each of said recesses, a plurality of electrical contact terminals arranged in said slider, driving means for moving said sliders along said recesses, and a cover plate having a plurality of openings for guiding pins to be connected, each said electrical contact terminal consisting of a single member formed to include a mounting shank portion, a resilient web portion and a blade portion, said web portion being formed at a slight angle of inclination with respect to said shank portion, each said terminal arranged in said sliders being opposed to the terminals arranged in adjacent sliders, said blade portion being provided with an aperture including an enlarged portion and a narrow slit, each said slider having a plurality of protruding shoulders, and said inclined web portion of said terminals being driven by said shoulders of the slider whereby said enlarged portion of the aperture is aligned with said opening in said cover plate.

4. An electrical connector comprising a housing formed as a single piece of a dielectric material having a plurality of recesses separated from each other by a partition, a pair of sliders in each of said recesses, a plurality of electrical contact terminals arranged in each said slider, driving means detachably mounted on said housing for moving said sliders along said recesses, and a cover plate having a plurality of openings for guiding pins to be connected, each said electrical contact terminal consisting of a single member formed to include a mounting shank portion, a resilient web portion and a blade portion, said web portion being formed at a slight angle of inclination with respect to said shank portion, said inclined web portion of said terminal arranged in one of said sliders in said recess being opposed to one of the other sliders of said pair of sliders in each recess, said blade portion being provided with an aperature including an enlarged portion and a narrow slot, each said slider having a plurality of protruding shoulders, said inclined web portion of said terminals being driven by said shoulders of the slider whereby said enlarged portion of the aperature is aligned with said opening in said cover plate.

5. An electrical connector claimed in claim 4 in which said driving means is adapted to mount on the connector so as to apply external force to said pair of sliders in each of said recesses.

6. An electrical connector claimed in claim 4 in which a leaf spring is mounted between said pair of sliders in each of said recesses.

7. An electrical connector claimed in claim 6 in which the opposed ends of said pair of sliders in said recess are protruded outwardly from said housing.

8. An electrical connector claimed in claim 7 in which said pair of sliders are driven by applying external force.

* * * * *